United States Patent [19]

Iwaki et al.

[11] 4,380,003

[45] Apr. 12, 1983

[54] RESISTOR DEVICE AND GENERATOR FOR CAR CHARGER

[75] Inventors: Yoshiyuki Iwaki; Hitoshi Goto, both of Himeji, Japan

[73] Assignee: Mitsubishi Denki Kabushiki Kaisha, Tokyo, Japan

[21] Appl. No.: 183,636

[22] Filed: Sep. 3, 1980

[30] Foreign Application Priority Data

Sep. 3, 1979 [JP] Japan ..... 54-113409
Sep. 14, 1979 [JP] Japan ..... 54-127957

[51] Int. Cl.[3] ..... H01C 1/01
[52] U.S. Cl. ..... 338/315; 338/332
[58] Field of Search ..... 338/315, 195, 332; 361/417–420

[56] References Cited

U.S. PATENT DOCUMENTS

| | | | |
|---|---|---|---|
| 3,217,311 | 11/1965 | Custer | 340/662 |
| 3,624,453 | 11/1971 | Rogers et al. | 338/332 X |
| 3,694,786 | 9/1972 | Rosema et al. | 338/315 X |
| 3,881,162 | 4/1975 | Caddock | 338/332 X |
| 3,916,144 | 10/1975 | Schuermann | 338/195 X |
| 4,119,937 | 10/1978 | Melvin | 338/332 |

*Primary Examiner*—C. L. Albritton
*Attorney, Agent, or Firm*—Oblon, Fisher, Spivak, McClelland & Maier

[57] ABSTRACT

A cylindrical spacer type resistor device is connected to a metal fixing plate or a print circuit plate by its electrodes without lead wires only by fixing the resistor device. The operation for connecting the lead wires can be eliminated. When the resistor device is used as a disconnection detecting resistor of a rotor in a generator for a car charger, the resistor device can be easily fixed in a narrow space.

6 Claims, 14 Drawing Figures

FIG. 10
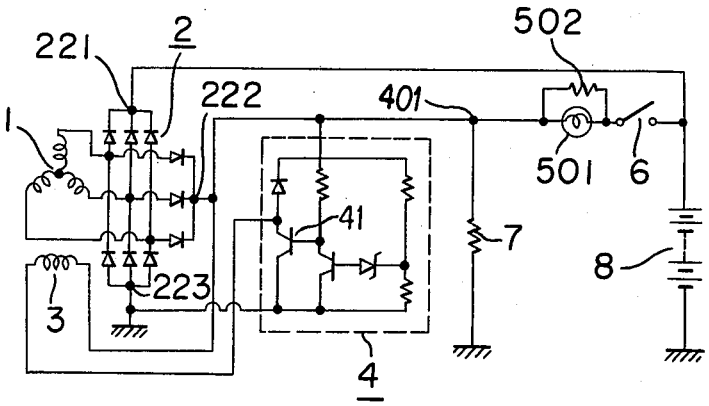
FIG. 12
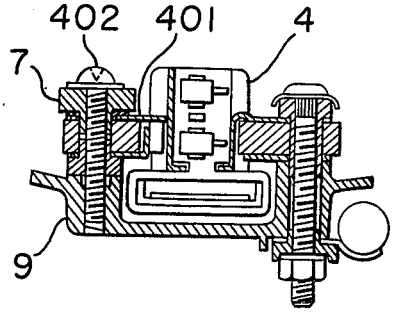
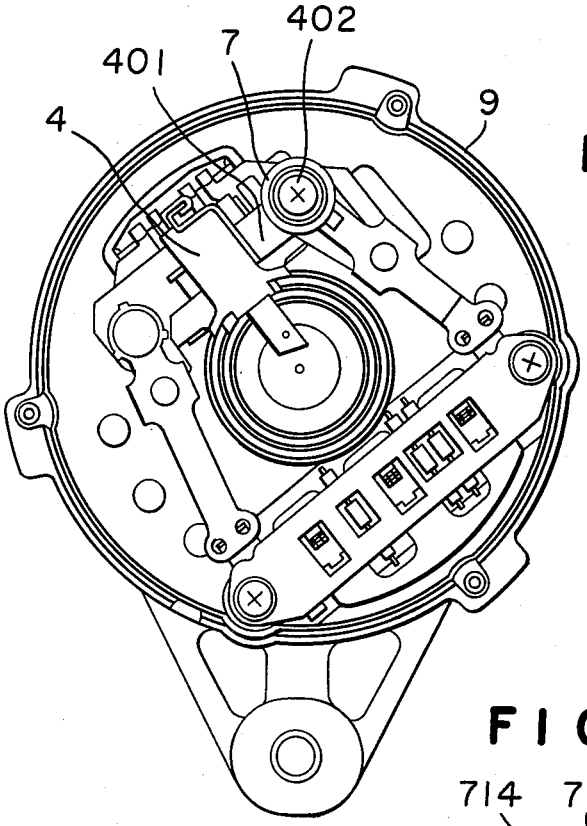
FIG. 11
FIG. 13
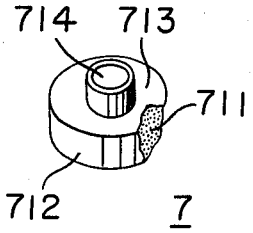
FIG. 14
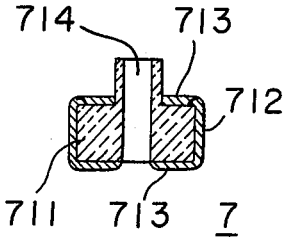

RESISTOR DEVICE AND GENERATOR FOR CAR CHARGER

BACKGROUND OF THE INVENTION

1. Field of the Invention

The present invention relates to a cylindrical spacer type resistor device and a disconnection detecting resistor device of a rotor of a generator for a car charger and a preparation thereof.

2. Description of the Prior Art

Various forms of independent parts as such resistor have been proposed. There is no resistor which forms an electric circuit by contacting it with a circuit board.

Referring to FIG. 1, the conventional device will be illustrated.

In FIG. 1, the reference (100) designates a resistor device; (101) designates a resistant substrate of a resistor device made of a ceramic; (102) designates a winding resistor wound on a peripheral part of the resistant substrate; (103) designates an insulating coated layer coated on the outer surface of the winding resistor; (104), (105) designate respectively lead wires connected to the winding resistor; (107) designates a through-hole formed in the inner peripheral part of the resistant substrate (101); (201) designates a part of the printed circuit board; (202) designates a metal fixed plate for grounding; (203) designates a female screw formed in the metal fixed plate; (204) designates a fixing screw screwed on the female screw (203) through the through-hole (107) of the resistant substrate (101) and the printed circuit board (201) whereby the resistor device (100) is fixed on the metal fixing plate (202).

The lead wires (104), (105) are respectively connected to the printed circuit board (201) and the electric conductive part of the metal fixing plate (202).

In the conventional device, an electric circuit is not formed only by fixing the resistor device (100) on the metal fixing plate (202). It is necessary to connect one lead wires (104) to a part of the metal fixing plate (202) to connect the other lead wire (105) to a conductive part of the print circuit board (201) by soldering or by nipping. The operation is comprehensive so as to cause low productivity.

Referring to FIG. 2, a conventional disconnection detecting resistor device of a rotor of a generator for a car charger, using a resistor device will be illustrated. In FIG. 2, the reference (7) designates a resistor device; (701), (702) respectively designate terminals of the resistor device (7); and (9) designates a bracket or fixing plate. The terminal (701) of the resistor device (7) is screwed to the second rectifier (222) and the terminal (702) is screwed to the bracket (9) as earth.

As shown in FIG. 2, in the structure, the space required for the resistor device (7) limits the arrangement of the other parts and the assembling is not easy.

SUMMARY OF THE INVENTION

It is an object of the present invention to provide a resistor device by connecting a resistant layer on an outer surface of a cylindrical resistant substrate and connecting an electrode layer on both surfaces of the resistant substrate whereby no lead wire is needed for fixing the resistor device through the fixing part to the printed circuit board.

It is another object of the present invention to provide a resistor device which easily connects the resistor device to the conductive part of the printed circuit board which is formed by baking the resistance layer and the electrode layer.

Yet another object of the present invention is to provide a resistor device and which easily assembled when such resistor device is equipped with the generator for a car charger.

BRIEF DESCRIPTION OF THE DRAWINGS

FIG. 10 is a circuit for illustrating the resistor device of the present invention;

FIG. 11 is a view of one embodiment of the present invention;

FIG. 12 is a sectional view of the resistor device of FIG. 11;

FIGS. 13 and 14 are respectively a schematic view and sectional view of the important part of one embodiment of the present invention.

DETAILED DESCRIPTION OF THE PREFERRED EMBODIMENTS

Figure 1:
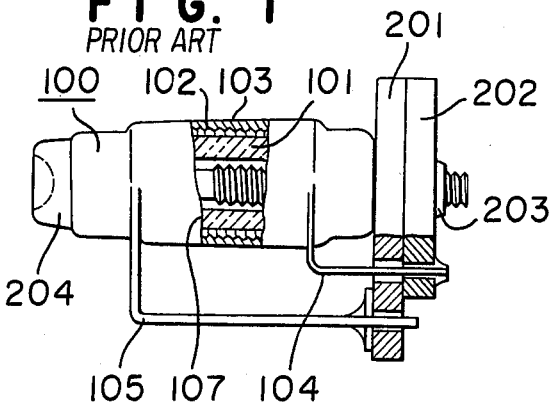
FIG. 1 PRIOR ART
FIG. 1 is a schematic view of the conventional resistor device.
Figure 3:
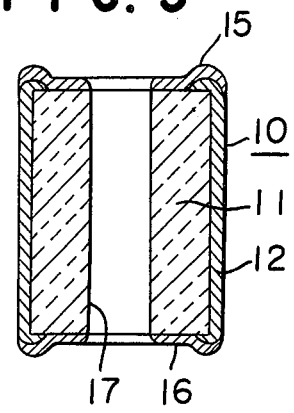
FIG. 3 is a sectional view of one embodiment of the present invention.
Figure 2:
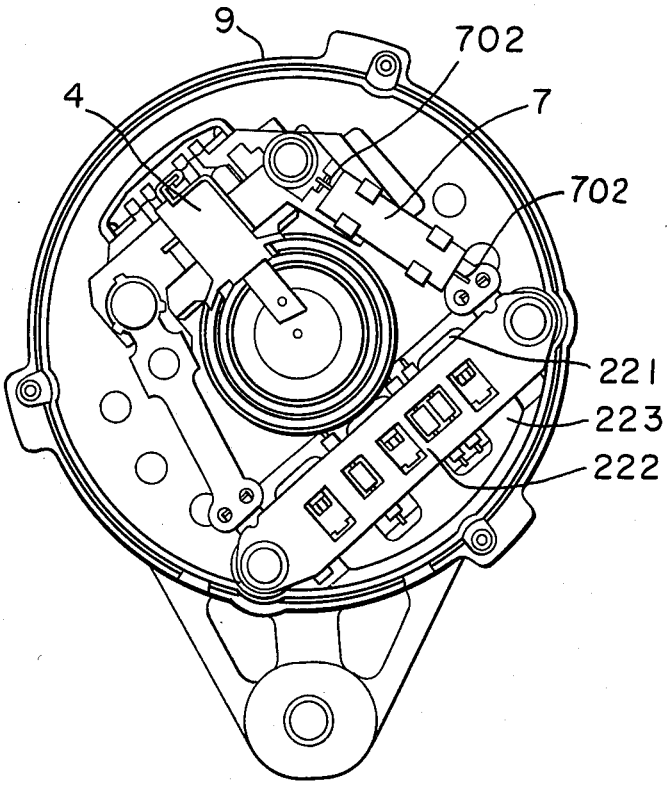
FIG. 2 PRIOR ART
FIG. 2 is a sectional view of one embodiment of the conventional disconnection detecting resistor device.
Figure 4:
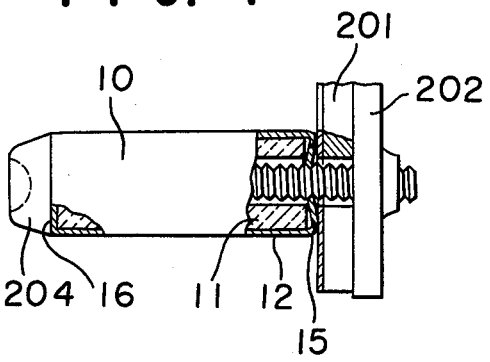
FIG. 4 is a partially broken front view of an arrangement of a spacer type resistor device of the embodiment of FIG. 3.

Referring to FIGS. 3 to 9, embodiments of the present invention will be illustrated.

In FIGS. 3 to 6, the reference (10) designates a resistor device; (11) designates a cylindrical resistant substrate prepared by baking a molded ceramic; (12) designates a resistance coated layer coated on the outer surface of the resistant or insulating substrate except on both end surfaces and near the end surfaces; (15), (16) respectively designate conductive coated layers as electrodes formed by coating with overlapping to the resistance coated layer (12), on all of both axial end surfaces of the resultant substrate (11); (17) designates a through-hole for fitting which is formed in the inner peripheral part of the resistant substrate (11).

The preparation of the resistor device (10) having the structure will be described.

The cylindrical resistant substrate (11) is prepared by baking a molded ceramic. A layer such as Pd-Ag type paste for a resistant layer (12) is coated on the outer surface of the resistance substrate (11). Each layer such as a Pd-Ag type paste made of electric conductive material (15), (16) is coated on each of both axial end surfaces of the resistant substrate (11). The coated layer (12) and the electric conductive layers (15), (16) are baked to prepare the resistor device (10). The resulted resultant device (10) is fixed through the printed circuit substrate (201) to the metal fixing plate (202) by screwing the fixing screw (204) through the hole (17) to the metal fixing plate (202). Thus, the electrode (16) is grounded through the fixing screw (204) on the metal fixing plate (202) and simultaneously the electrode (15) is connected to the electric conductive part of the printed circuit board (201).

In this embodiment, the resistor device (10) is only fixed to the metal fixing plate (202) by the fixing screw (204) whereby the electrodes (15), (16) are respectively connected to the printed circuit board (201) and the metal fixing plate (202) without using lead wires (104), (105) which are required in the conventional one. It is possible to eliminate the complicated operations of soldering or nipping for connections of the lead wires (104), (105).

Figure 7:
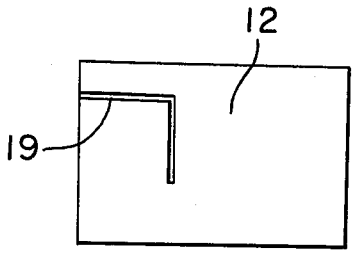
FIG. 7 is a front view of the important part of the other embodiment of the present invention.
Figure 5:
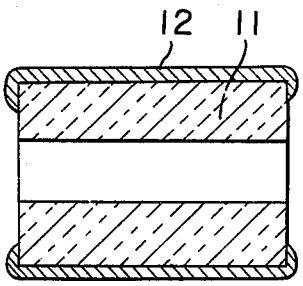
FIGS. 5 and 6 respectively sectional views showing the process for preparing the spacer type resistor device of the embodiment shown in FIG. 3.

As shown in FIG. 7, the resistance can be easily controlled by sand-blasting method or forming a slit by a razor on the resistant layer (12) of the resistor device (10).

Figure 8:
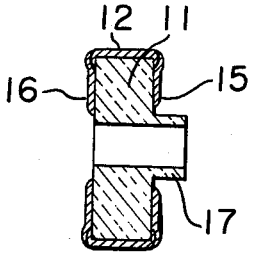
FIG. 8 is a sectional view of the other embodiment of the present invention.
Figure 6:
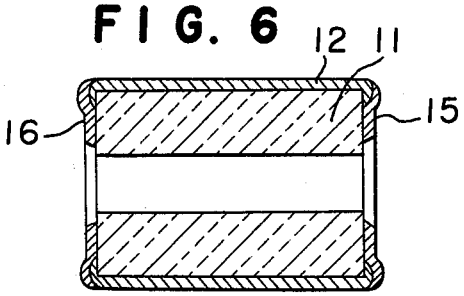

As shown in FIG. 8, one end surface of the resistant substrate (11) is extended to form the cylindrical projection (17) whereby the projection (17) can be used for deciding the position of the resistor device (10) when the resistor device (10) is used as a spacer.

Figure 9:
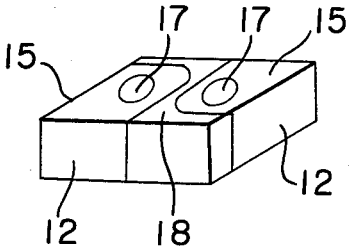
FIG. 9 is a schematic view of the other embodiment of the present invention.

As shown in FIG. 9, a plurality of holes (17) are formed on the resistant substrate (11) and the resistance layer (12) and the electric conductive layers (15), (16) are respectively printed on the resistant substrate (11) so as to discriminate the regions for each of the holes (17) and the resistant substrate is fixed to the print circuit board (201) and the metal fixing plate (202) whereby the productivity is further improved. The parts (18) are used for discriminating the regions of the resistor device.

In accordance with the present invention, the resistance layer is formed on the outer surface of the resistant substrate except both end surfaces or near the cylindrical substrate and the electrode layers are formed on both the end surfaces of the resistant substrate and they are formed by baking the coated layers. Even when resistor device is fixed on the print circuit board by fixing screws the electric conductive part of the print circuit board can be connected to the resistor device only fixing the resistor device to the print circuit board. This operation is remarkably easy in comparison with the conventional connection of a resistor device to a print circuit board through lead wires by soldering or nipping. Moreover, the resistor circuit can be effectively formed with the effect of the spacer.

The resistor device used for the generator for a car charger of the present invention will be illustrated.

FIG. 10 is a circuit diagram for showing the positions on the circuit of the resistor device of the present invention. In FIG. 10, the reference (1) designates an armature coil; (2) designates a rectifier for rectifying the AC output of the armature coil which includes a first rectifying output terminal (221), a second rectifying output terminal (222) and a third rectifying output terminal (223); (3) designates a field coil for exciting by the second rectifying output terminal (222), (4) designates a voltage regulator which connects between the second rectifying output terminal (222) and the battery (8); (401) designates a switching element of the voltage regulator for intermittently feeding the current to the field coil (3); (501) designates a charge display lamp; (502) designates parallel resistors; (6) designates a key-switch; (7) designates a resistor device connecting one end to the middle point between the display lamp (501) and the second rectifying output terminal (222) and connecting the other end to earth; and (8) designates a battery.

The operation of the embodiment will now be discussed.

When the key-switch (8) is turned on, the current is fed from the battery (8) through display lamp (501), to the earth through the resistor device (7) for one loop and through the field coil (3) and the switching element (401) for the other loop whereby the display lamp (501) is turned on. When the generator rotates to start the generation, the voltage at the first rectifying output terminal (221) is the same as the second rectifying output terminal (222). When the voltage of the second rectifier (222) reaches substantially the same as that of the battery (8), the potential difference between both ends of the display lamp (501) is lost to turn off the light. The current is fed through the second rectifier (222) to the resistor device (7) and the field coil (3). If the field coil (3) is disconnected, the field current is lost whereby the generator can not generate and the potential between the first rectifying output terminal (221) and the second rectifying output (222) is lost and the potential at the second rectifying output terminal of the display lamp (501) is lowered. Therefore, the current is fed from the battery (8) through the display lamp (501) to the resistor device (7) whereby the display lamp (501) is turned on to display the fact of the disconnection of the field coil (3) of the generator.

In FIGS. 11 to 14, the reference numeral (7) designates a hollow cylindrical resistor device and the hollow part of the resistor device (7) is fitted and the resistor device is fixed to the bracket or fixing plate (9) by the screw (402) for fixing the voltage regulator (4) to contact its one end with the terminal (401) of the voltage regulator (4) and to contact its other end with the bracket (9).

Referring to FIGS. 13 and 14, the resistor device (7) will be further illustrated. In Figures, the reference numeral (711) designates ceramic substrate; (712) designates a resistance layer; (713) designates an electrode layer; (714) designates a hollow part in the hollow cylindrical form to be the same structure as the insulating spacer.

In accordance with the embodiment of the present invention, the hollow cylindrical resistor device is used for forming a circuit for displaying by the display lamp when the field coil connected to earth and the middle point between the second rectifying output terminal for rectifying the AC output of the armature coil and the discharge lamp. The hollow resistor device is fastened on the body of the generator by the screw for fitting into the hollow part whereby the resistor device is connected between the middle point and earth. It is unnecessary to consider the space necessary for placing the resistor in the design. In the assembling operation, it is the same as the insertion of the spacer, whereby the complicate operation for connecting the resistor device can be eliminated. Thus remarkable advantages can be obtained.

I claim:

1. A spacer type resistor device for mounting on a printed circuit board and a fixing plate comprising:

at least one insulating substrate having a throughhole formed therein;

a resistance layer formed on the outer surface of each of said at least one insulating substrate;

first and second electrode layers positioned adjacent opposite axial end surfaces of said at least one insulating substrate and contacting said resistance layer; and means disposed within said throughhole for securing said at least one insulating substrate to said board and said plate and contacting one of said first and second electrode layers.

2. The spacer type resistor device according to claim 1, wherein said insulating substrate further comprises a projection extending axially from at least one of said opposite axial end surfaces of said at least one insulating substrate.

3. The spacer type resistor device according to claim 1 or 2 wherein said at least one insulating substrate further comprises at least a first and second insulating substrate and further comprising:

means interconnecting said first and second insulating substrate.

4. The spacer type resistor device according to claim 1 wherein the outer surface of said resistance layer has a slit formed therein so as to control resistance of said resistor device.

5. The spacer type resistor device according to claim 1 wherein said insulating substrate further comprises ceramic material.

6. The spacer type resistor device according to claim 1 wherein said securing means further comprises means for interconnecting said first electrode layer with said fixing plate and for interconnecting said second electrode layer with said printed circuit board.

* * * * *